US007270608B2

(12) United States Patent
Cho

(10) Patent No.: US 7,270,608 B2
(45) Date of Patent: Sep. 18, 2007

(54) COLLAPSIBLE NET

(76) Inventor: Kwang Han Cho, 148 S. Gramercy Pl. #16, Los Angeles, CA (US) 90004

( * ) Notice: Subject to any disclaimer, the term of this patent is extended or adjusted under 35 U.S.C. 154(b) by 0 days.

(21) Appl. No.: 11/345,580

(22) Filed: Feb. 1, 2006

(65) Prior Publication Data

US 2007/0176370 A1 Aug. 2, 2007

(51) Int. Cl.
*A63B 63/00* (2006.01)
*A63B 69/36* (2006.01)

(52) U.S. Cl. ..... 473/197; 473/421; 473/476; 273/400

(58) Field of Classification Search ..... 473/476–478, 473/197, 454–456, 421; 273/398–402
See application file for complete search history.

(56) References Cited

U.S. PATENT DOCUMENTS 2,819,901 A * 1/1958 Mateja ..... 473/421
4,072,295 A * 2/1978 Roberts ..... 256/26
4,381,110 A * 4/1983 Balaz ..... 473/197
4,969,651 A * 11/1990 Comartin ..... 473/410
5,088,740 A * 2/1992 Peterson ..... 273/410
5,427,381 A * 6/1995 Macaluso et al. ..... 273/400
6,352,480 B1 * 3/2002 Macaluso ..... 473/197
6,766,815 B2 * 7/2004 Zheng ..... 135/143
2003/0181264 A1 * 9/2003 Yoon ..... 473/421
2004/0209713 A1 * 10/2004 Zheng ..... 473/471
2005/0176518 A1 * 8/2005 Doherty et al. ..... 473/197

* cited by examiner

*Primary Examiner*—Mark S Graham
(74) *Attorney, Agent, or Firm*—John K. Park; Park Law Firm

(57) ABSTRACT

A collapsible net for stopping flying balls and for installing on a floor includes a collapsible center coil loop, collapsible first and second side coil loops, a vertical fabric portion, top and bottom fabric portions, and top and bottom straps. The collapsible center coil loop includes a top part, a bottom part, and first and second side parts. Each side coil loop includes a top part, a bottom part, and inner and outer side parts. Each inner side part is connected to each side part of the collapsible center coil loop. The vertical fabric portion covers the openings of the coil loops for stopping the flying balls. The opening angle of the side coil loops are controllable. The propping device includes pecks and strings to fix the net to the floor.

20 Claims, 8 Drawing Sheets

COLLAPSIBLE NET

BACKGROUND OF THE INVENTION

The present invention relates to a collapsible net. More particularly, this invention relates to a collapsible net, which has three portions of net.

A net has been quite a useful thing since its invention by some cavemen. A net comprises a mesh structure. The mesh extends across a certain amount of surface and stops anything along the mesh string only. Actually, the useful aspect of the net resides in the fact that it can also stop anything larger than the size of the eyes of mesh.

Therefore, the fishing net can scoop out big fish leaving water and small fish behind. The net surrounding the little league stadium keeps the flying balls and foul balls from hitting the spectator and at the same allows the spectator to look through itself to watch the game.

The two big users of net might be the fishing industry and the sports.

In everyday life, the sport is much nearer to the people than the fishing industry. The net is quite useful not only at a regular sports game in a stadium, a diamond, or a link, but also at a practice in a small and limited place such as backyard, sideway, and even indoors.

Accordingly, a need for a collapsible net has been present for a long time considering the endless demands from the various sports. This invention is directed to solve these problems and satisfy the long-felt need.

SUMMARY OF THE INVENTION

The present invention contrives to solve the disadvantages of the prior art.

An objective of the invention is to provide a collapsible net.

Another object of the invention is to provide a collapsible net that has three portions of net.

Still another object of the invention is to provide a collapsible net that is easy to deploy and store according to the changing needs of the situation.

A collapsible net for stopping flying balls and for installing on a floor includes a collapsible center coil loop, a collapsible first side coil loop, a collapsible second side coil loop, a vertical fabric portion, a top fabric portion, a bottom fabric portion, a top strap, and a bottom strap.

The collapsible center coil loop includes a top part, a bottom part, and first and second side parts.

The collapsible first side coil loop includes a top part, a bottom part, and inner and outer side parts. The inner side part is connected to the first side part of the collapsible center coil loop.

The collapsible second side coil loop includes a top part, a bottom part, and inner and outer side parts. The inner side part is connected to the second side part of the collapsible center coil loop.

The vertical fabric portion covers the openings of the coil loops for stopping the flying balls.

The top fabric portion is for holding the top parts of the coil loops and for covering a top surface defined by the top parts of the coil loops.

The bottom fabric portion is for holding the bottom parts of the coil loops and for covering a bottom surface defined by the bottom parts of the coil loops.

The top strap is for connecting the upper ends of the outer side part of the first and second coil loops.

The bottom strap is for connecting the lower ends of the outer side part of the first and second coil loops.

The propping device is for holding the collapsible net down to the floor.

The collapsible center coil loop, the collapsible first side coil loop, and the collapsible second side coil loop form a substantially concave-truncated-cylinder-shaped net for catching the flying balls.

The coil loops are substantially quadrilateral, preferably rectangular.

The propping device includes a plurality of pecks, or stakes, for fixing the bottom fabric portion to the floor. The bottom fabric portion includes a plurality of flanges with holes, and the hole is adapted to accept the peck, or stakes. The flanges of the bottom fabric portion are provided at predetermined locations along the bottom parts of the coil loops.

The predetermined locations for the flanges includes a joint portion of the bottom part and the outer side part of the first side coil loop, a joint portion of the bottom part and the outer side part of the second side coil loop, a joint portion of the bottom parts of the center coil loop and the first side coil loop, and a joint portion of the bottom parts of the center coil loop and the second side coil loop.

The propping device further includes a plurality of strings for fixing the top parts of the coil loops to the floor, and each string includes a first end and a second end. The first ends of the strings are connected to the predetermined locations along the top parts of the coil loops. The predetermined locations comprises a joint portion of the top part and the outer side part of the first side coil loop, a joint portion of the top part and the outer side part of the second side coil loop, a joint portion of the top parts of the center coil loop and the first side coil loop, and a joint portion of the top parts of the center coil loop and the second side coil loop.

The second ends of the strings are connected to the stakes, and the stakes are stretched and fixed to the floor to make the string tight enough to hold the collapsible net.

The vertical fabric portion comprises a net portion and a sleeve portion. The sleeve portion covers and clings to the coil loops and is connected to the net portion.

The top fabric portion includes a net, and the top fabric portion is confined by the top parts of the coil loops and the top strap.

The bottom fabric portion includes a net. The bottom fabric portion is confined by the bottom parts of the coil loops and the bottom strap.

The top and bottom straps are elastic.

The collapsible net may further include two elastic poles having an upper end and a lower end, the length of which is longer than the side part of the coil loops. The elastic poles are elastic, and the elasticity of the elastic poles is lower than the elasticity of the top strap. The top strap includes a plurality of holes for securing the upper end of the elastic poles, and the lower parts of the elastic poles can be fixed or secured by fabric portion to the side parts of the first and second coil loop.

As shown in FIG. 8, the elastic poles are connected into one and threaded along the holes provided at the edge of the top fabric portion, heightening the top fabric portion by bending the threaded elastic poles upward.

The opening angle of the concave-truncated-cylinder-shape is controllable, and the opening angle is defined by the surfaces of the first and second side coil loops.

The opening angles ranges from about zero (0) to about one hundred eighty (180) degrees.

The coil loops are installed perpendicularly to the floor.

The sleeve portion covers and clings to the vertices of the quadrilateral coil loops, and the sleeve portion is triangular.

The collapsible net further includes a target, and the target is installed on the vertical fabric portion covering the center coil loop.

The advantages of the present invention are: (1) the collapsible net is convenient to install; (2) the collapsible net can control the opening angle of the net; and (3) the collapsible net stops and catches the flying balls due to the two side fly nets.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
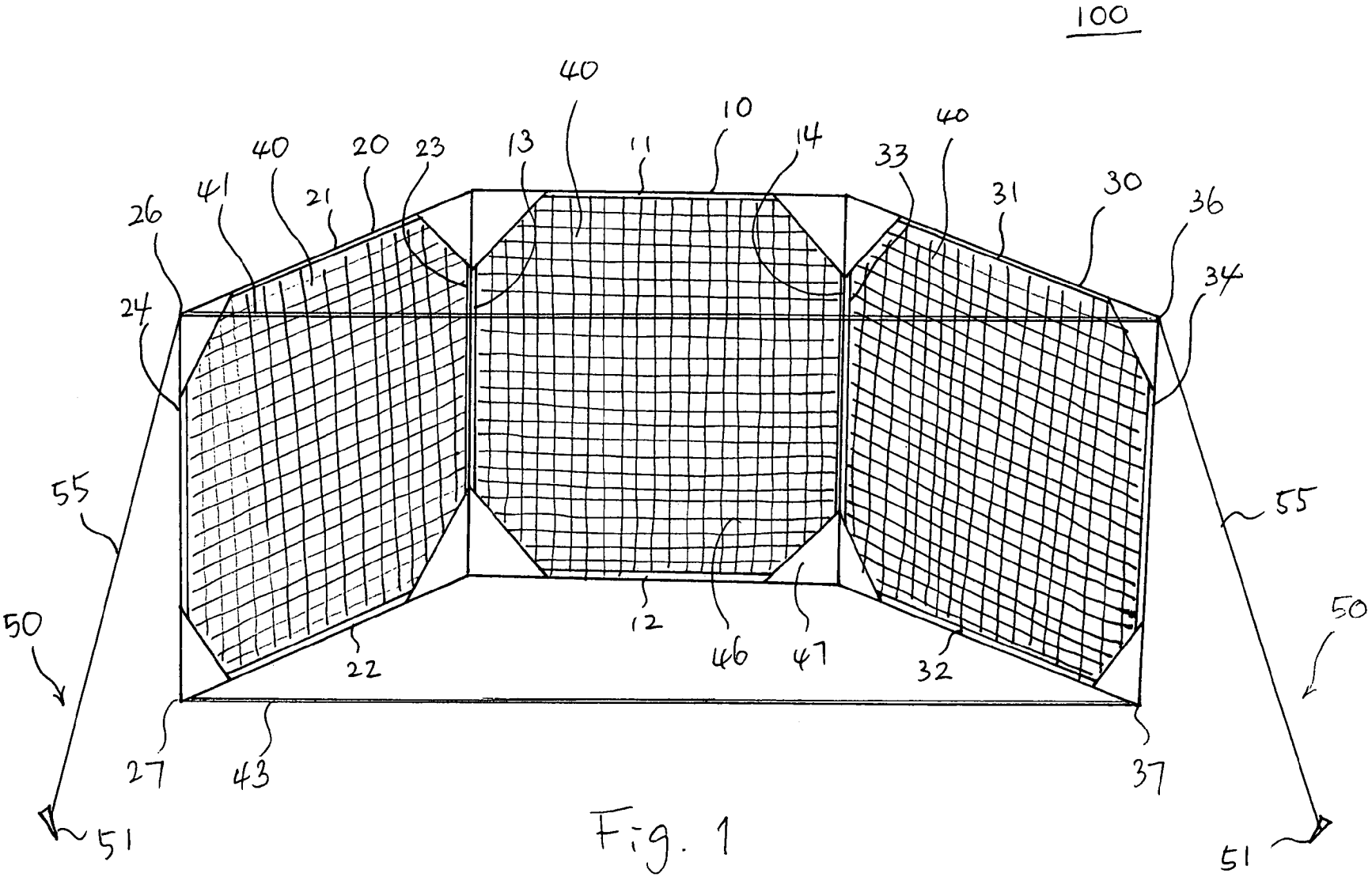
FIG. 1 is a perspective view showing a collapsible net according to the present invention.

FIGS. 1 through 4 show a collapsible net 100 installed on a floor.

The collapsible net 100 for stopping flying balls and for installing on a floor includes a collapsible center coil loop 10, a collapsible first side coil loop 20, a collapsible second side coil loop 30, a vertical fabric portion 40, a top fabric portion 42, a bottom fabric portion 44, a top strap 41, a bottom strap 43, and a propping device 50 as shown in FIGS. 1 through 5.

The collapsible center coil loop 10 includes a top part 11, a bottom part 12, and first and second side parts 13, 14.

The collapsible first side coil loop 20 includes a top part 21, a bottom part 22, and inner and outer side parts 23, 24. The inner side part 23 is connected to the first side part 13 of the collapsible center coil loop 10.

The collapsible second side coil loop 30 includes a top part 31, a bottom part 32, and inner and outer side parts 33, 34. The inner side part 33 is connected to the second side part 14 of the collapsible center coil loop 10.

Figure 2:
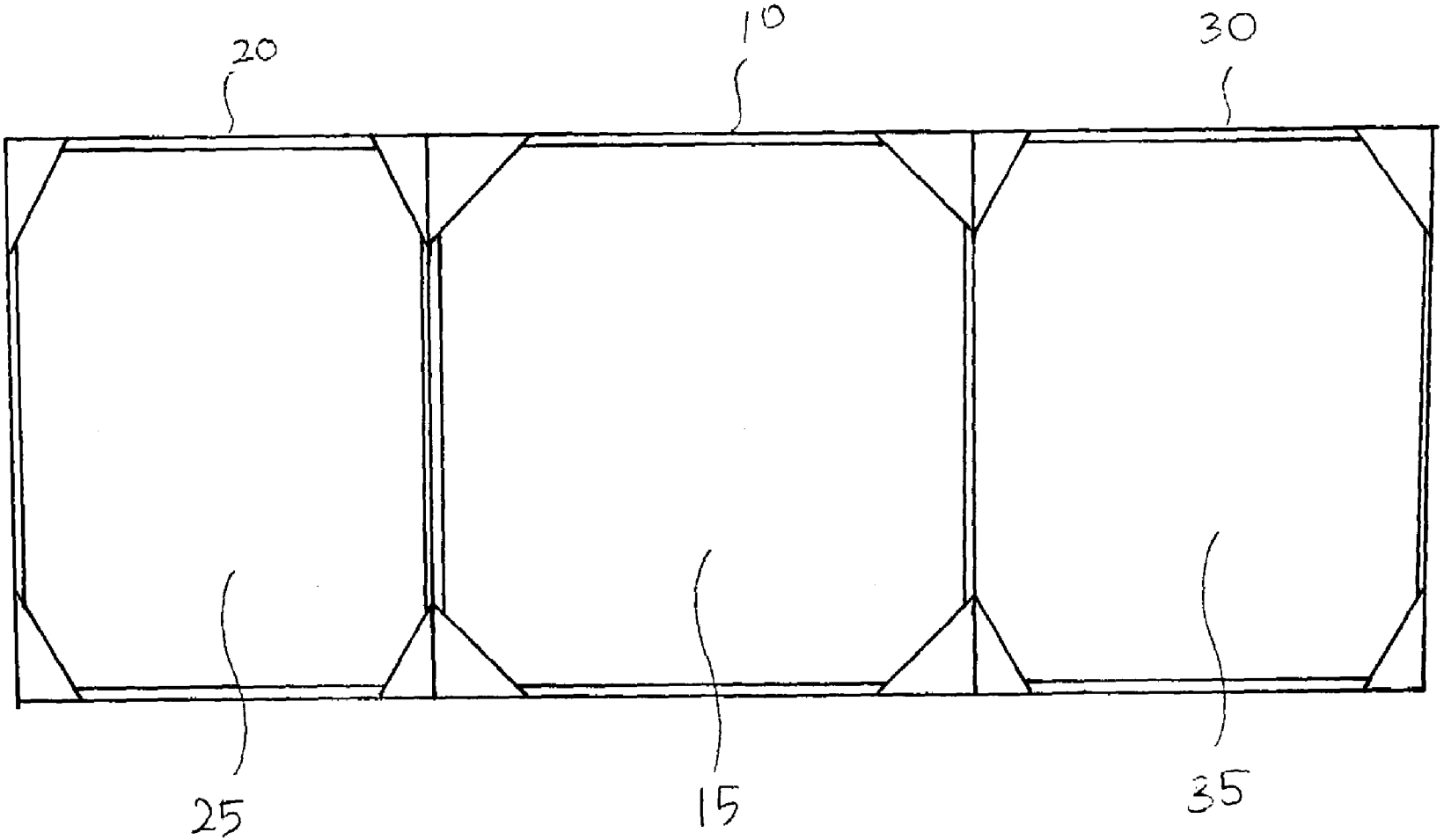
FIG. 2 is a front elevation view of the collapsible net.
Figure 3:
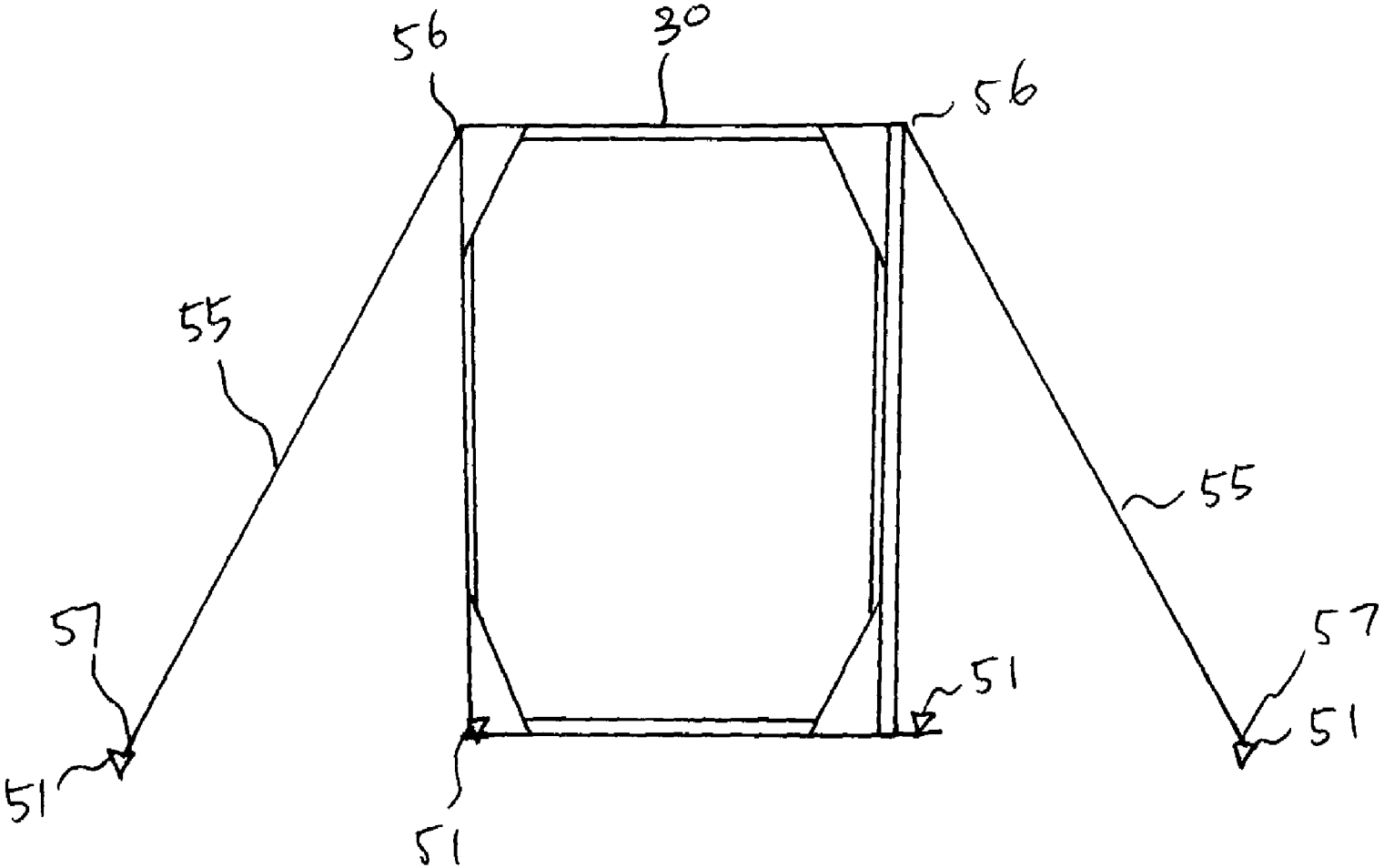
FIG. 3 is a side elevation view of the collapsible net.

The vertical fabric portion 40 covers the openings 15, 25, 35 of the coil loops 10, 20, 30 for stopping the flying balls as shown in FIG. 2.

The top fabric portion 42 is for holding the top parts 11, 21, 31 of the coil loops 10, 20, 30 and for covering a top surface defined by the top parts 11, 21, 31 of the coil loops 10, 20, 30.

The bottom fabric portion 44 is for holding the bottom parts 12, 22, 32 of the coil loops 10, 20, 30 and for covering a bottom surface defined by the bottom parts 12, 22, 32 of the coil loops 10, 20, 30.

The top strap 41 is for connecting the upper ends 26, 36 of the outer side parts 24, 34 of the first and second coil loops 20, 30.

The bottom strap 43 is for connecting the lower ends 27, 37 of the outer side parts 24, 34 of the first and second coil loops 20, 30.

The propping device 50 is for holding the collapsible net down to the floor.

Figure 4:
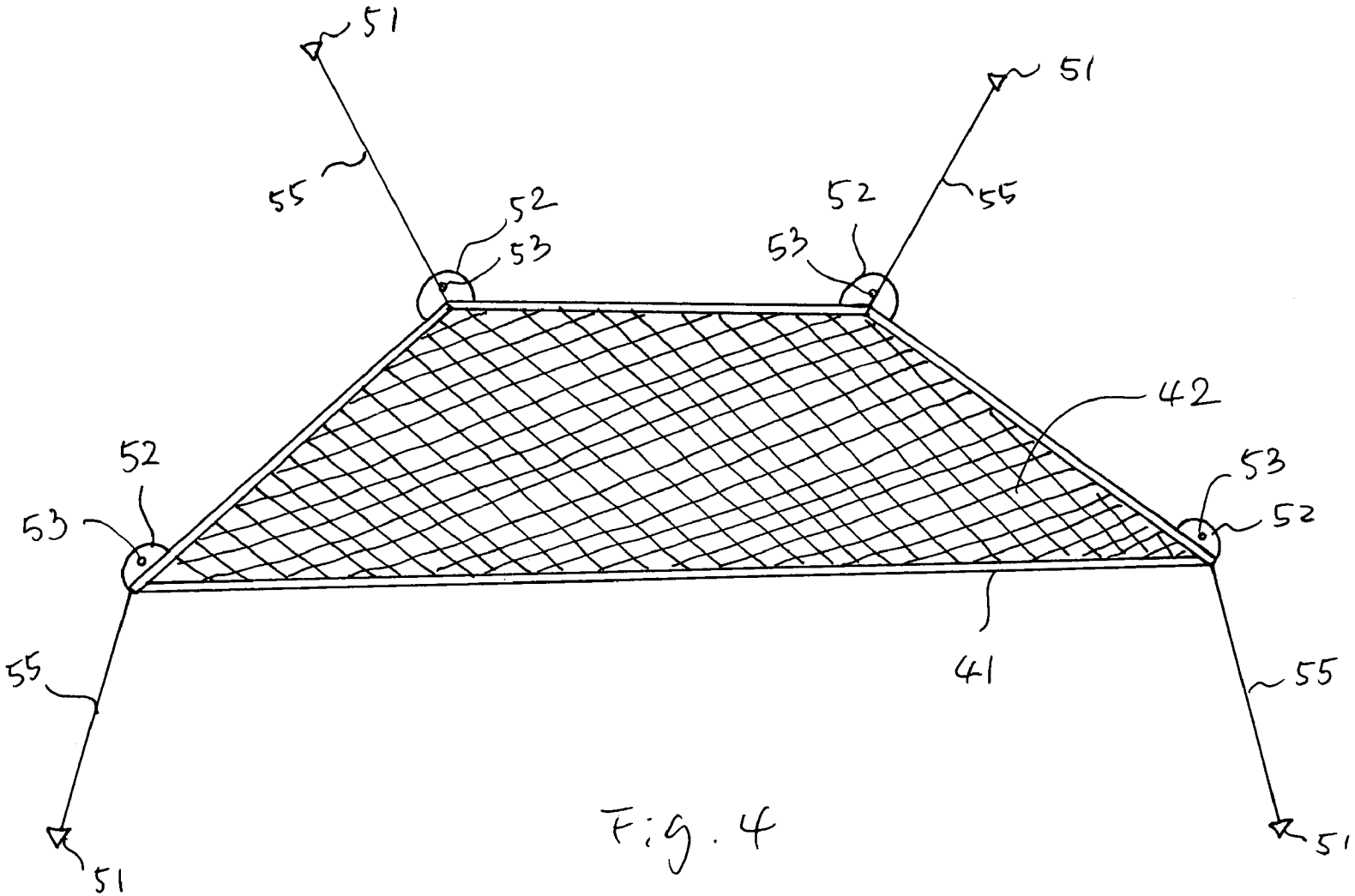
FIG. 4 is a top elevation view of the collapsible net.

The vertical fabric portion 40 on the collapsible center coil loop 10, the collapsible first side coil loop 20, and the collapsible second side coil loop 30 form a substantially concave-truncated-cylinder-shaped net for catching the flying balls as shown clearly in FIG. 4.

The coil loops 10, 20, 30 are substantially quadrilateral, preferably rectangular.

The propping device 50 includes a plurality of pecks, or stakes, 51 for fixing the bottom fabric portion 44 to the floor. The bottom fabric portion 44 includes a plurality of flanges 52 with holes 54, and the hole 54 is adapted to accept the peck, or stakes, 51 as shown in FIG. 4. The flanges 52 of the bottom fabric portion 44 are provided at predetermined locations along the bottom parts 12, 22, 32 of the coil loops 10, 20, 30.

The predetermined locations for the flanges 52 includes a joint portion of the bottom part 22 and the outer side part 24 of the first side coil loop 20, a joint portion of the bottom part 32 and the outer side part 34 of The propping device 50 further includes a plurality of strings 55 for fixing the top parts 11, 21, 31 of the coil loops 10, 20, 30 to the floor, and each string 55 includes a first end 56 and a second end 57. The first ends 56 of the strings 55 are connected to the predetermined locations along the top parts 11, 21, 31 of the coil loops 10, 20, 30. The predetermined locations include a joint portion of the top part 21 and the outer side part 24 of the first side coil loop 20, a joint portion of the top part 31 and the outer side part 34 of the second side coil loop 30, a joint portion of the top parts 11, 21 of the center coil loop 10 and the first side coil loop 20, and a joint portion of the top parts 11, 31 of the center coil loop 10 and the second side coil loop 30.

The propping device 50 further includes a plurality of strings 55 for fixing the top parts 11, 21, 31 of the coil loops 10, 20, 30 to the floor, and each string 55 includes a first end 56 and a second end 57. The first ends 56 of the strings 55 are connected to the predetermined locations along the top parts 11, 21, 31 of the coil loops 10, 20, 30. The predetermined locations include a joint portion of the top part 21 and the outer side part 24 of the first side coil loop 20, a joint portion of the top part 31 and the outer side part 34 of the second side coil loop 30, a joint portion of the top parts 11, 21 of the center coil loop 10 and the first side coil loop 20, and a joint portion of the top parts 11, 31 of the center coil loop 10 and the second side coil loop 30.

The second ends 57 of the strings 55 are connected to the stakes 51, and the stakes 51 are stretched and fixed to the floor to make the string 55 tight enough to hold the collapsible net 100.

The vertical fabric portion 40 includes a net portion 46 and a sleeve portion 47. The sleeve portion 47 covers and clings to the coil loops 10, 20, 30 and is connected to the net portion 46.

The top fabric portion 42 includes a net, and the top fabric portion 42 is confined by the top parts 11, 21, 31 of the coil loops 10, 20, 30 and the top strap 41.

The bottom fabric portion 44 includes a net. The bottom fabric portion 44 is confined by the bottom parts 12, 22, 32 of the coil loops 10, 20, 30 and the bottom strap 43.

Figure 5:
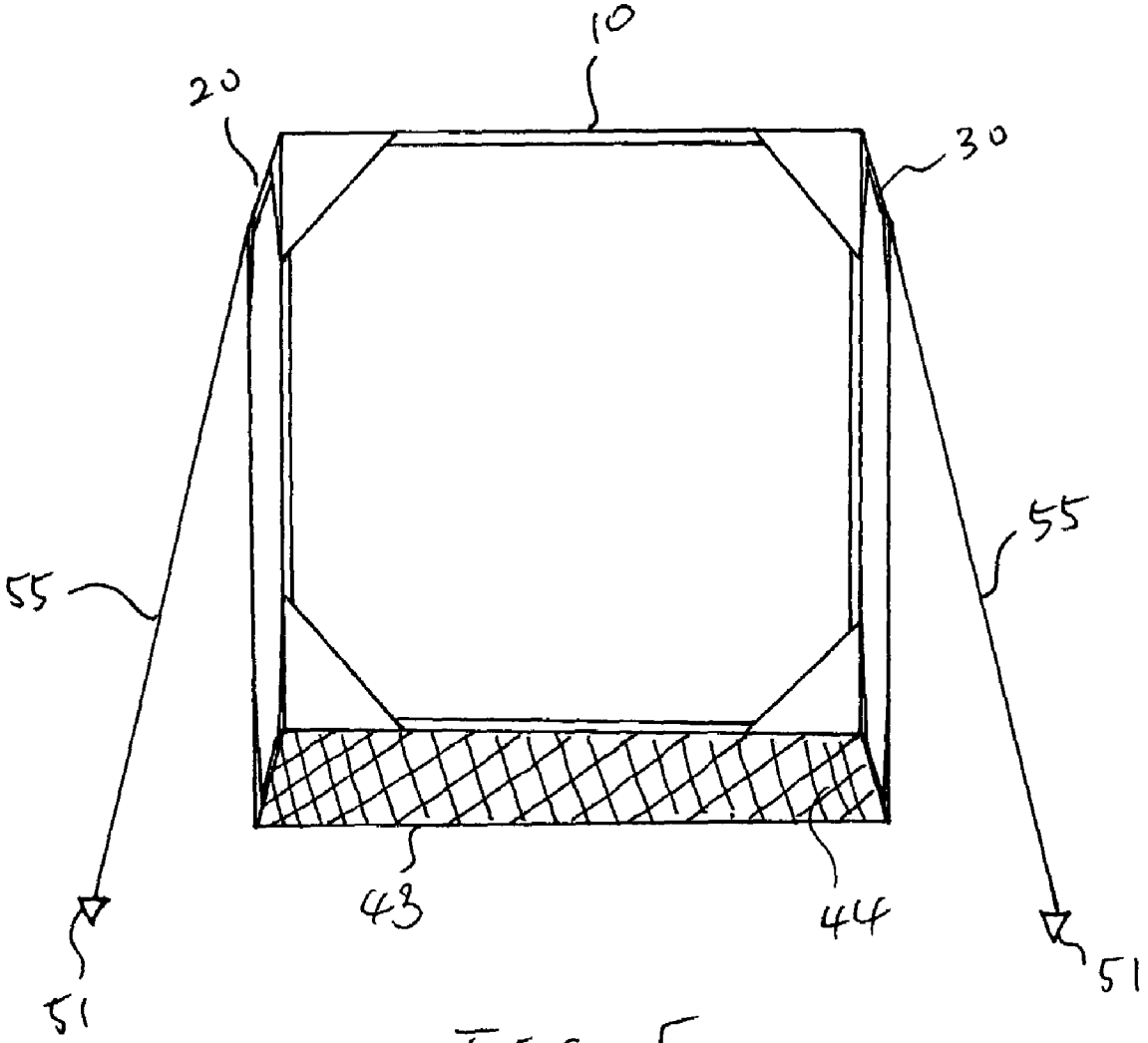
FIG. 5 a perspective view of the collapsible net with the side coil loops substantially parallel.
Figure 6:
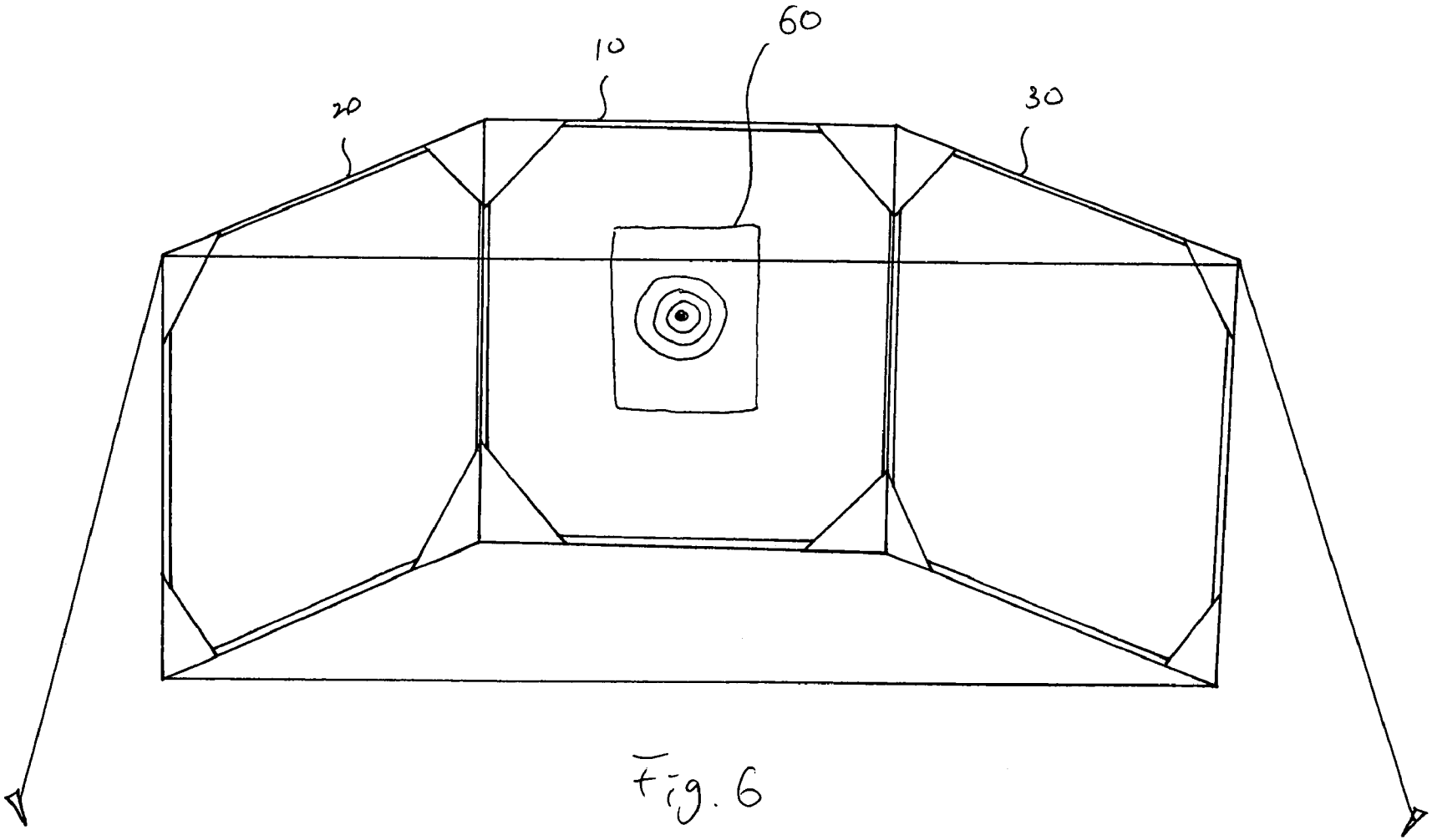
FIG. 6 is a perspective view showing a collapsible net with a target.

The opening angle of the concave-truncated-cylinder-shape is controllable as shown in FIGS. 1 and 5, and the opening angle is defined by the surfaces of the first and second side coil loops 20, 30.

The opening angles ranges from about zero (0) to about one hundred eighty (180) degrees.

The coil loops 10, 20, 30 are installed perpendicularly to the floor.

The sleeve portion 47 covers and clings to the vertices of the quadrilateral coil loops 10, 20, 30, and the sleeve portion 47 is substantially triangular.

The collapsible net 100 further includes a target 60, and the target 60 is installed on the vertical fabric portion 40 covering the center coil loop 10.

The coil loops 10, 20, 30 may be coilable loop members which are connected foldably into one.

The top and bottom straps 41, 43 may be elastic.

Figure 7:
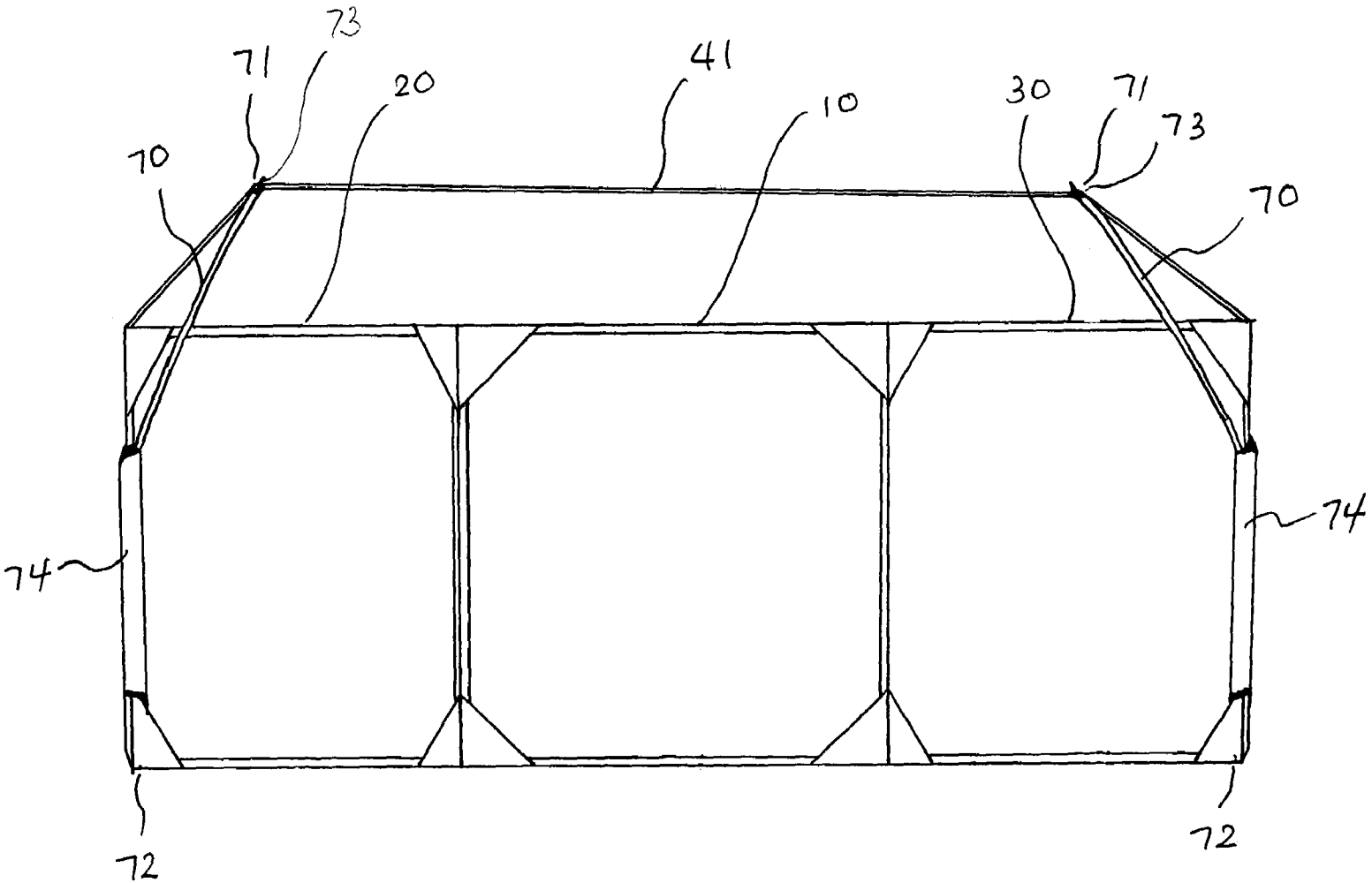
FIG. 7 is a perspective front view of the collapsible net with the elastic poles installed vertically to heighten the top fabric portion.

As shown in FIG. 7, the collapsible net 100 may further include two elastic poles 70 having an upper end 71 and a lower end 72, the length of which is longer than the side part 24, 34 of the coil loops 20, 30. The elastic poles 70 are elastic, but the elasticity of the elastic poles 70 is lower than the elasticity of the top strap 41. The top strap 41 includes a plurality of holes 73 for securing the upper end 71 of the elastic poles 70, and the lower parts of the elastic poles 70 including the lower end 72 can be fixed or secured by a fabric portion 74 to the side parts 24, 34 of the first and second coil loop 20, 30. Since the elastic poles 70 are longer than the side parts 24, 34 of the first and second coil loop 20, 30, the catching zone of the net 100 can be extended vertically.

Figure 8:
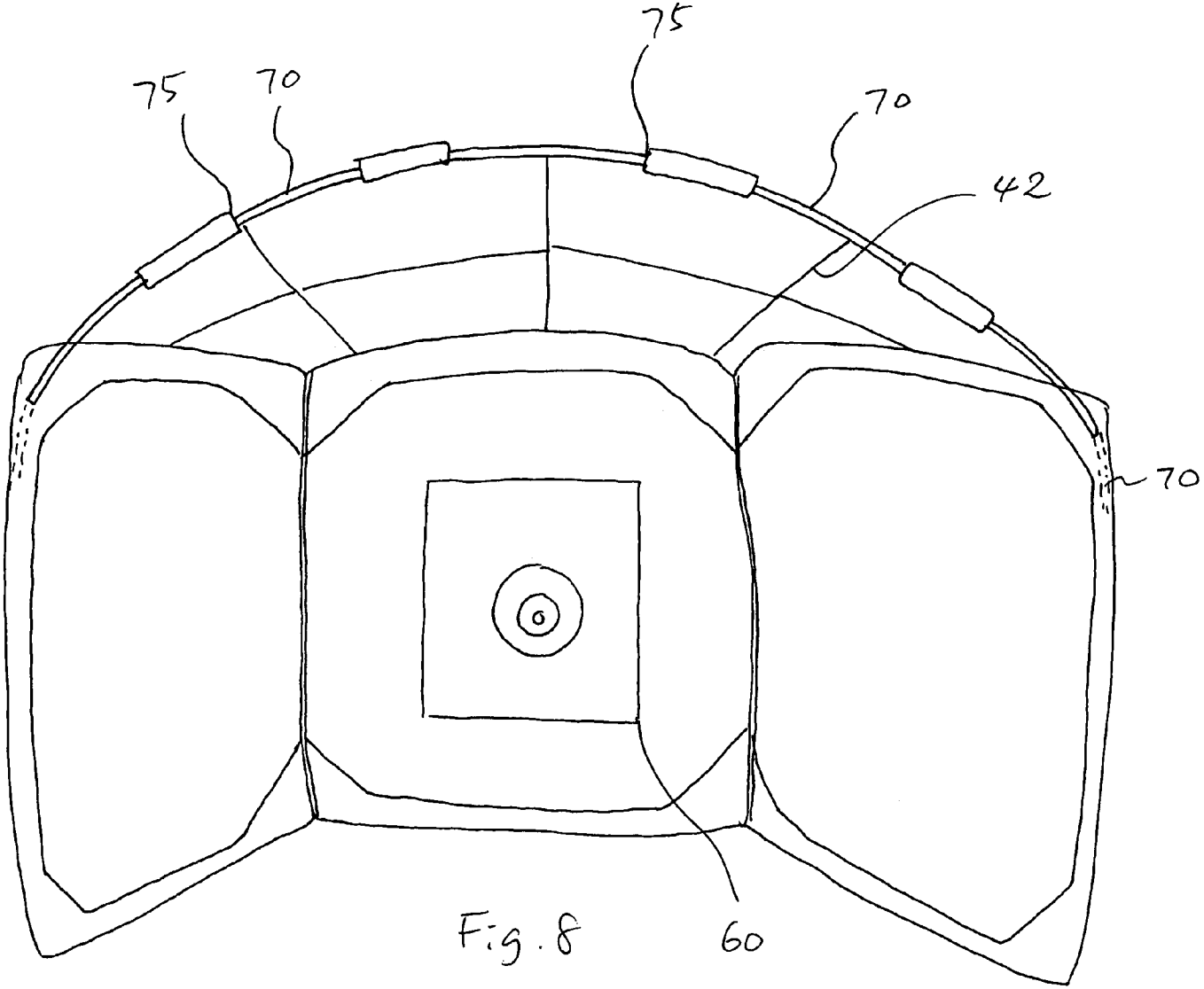
FIG. 8 is a perspective front view of the collapsible net with the elastic poles installed in arch to heighten the top fabric portion.

As shown in FIG. 8, the elastic poles 70 are connected into one and threaded along the holes 75 provided at the edge of the top fabric portion 42, heightening the top fabric portion by bending the threaded elastic poles 70 upward.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A collapsible net for stopping flying balls and for installing on a floor comprising:

a) a collapsible center coil loop comprising a top part, a bottom part, and first and second aide parts;

b) a collapsible first side coil loop comprising a top part, a bottom part, and inner and outer side parts, wherein the inner side part is connected to the first side part of the collapsible center coil loop;

c) a collapsible second side coil loop comprising a top part, a bottom part, and inner and outer side parts, wherein the inner side part is connected to the second side part of the collapsible center coil loop;

d) a vertical fabric portion for covering the openings of the coil loops for stopping the flying balls;

e) a top fabric portion for holding the top parts of the coil loops and for covering a top surface defined by the top parts of the coil loops;

f) a bottom fabric portion for holding the bottom parts of the coil loops and for covering a bottom surface defined by the bottom parts of the coil loops;

g) a top strap for connecting the upper ends of the outer side part of the first and second coil loops;

h) a bottom strap for connecting the lower ends of the outer side part of the first and second coil loops; and i) a propping device for holding the collapsible net down to the floor, wherein the vertical fabric portion on the collapsible center coil loop, the collapsible first side coil loop, and the collapsible second side coil loop form a substantially concave-truncated-cylinder-shaped net for catching the flying balls.

2. The collapsible net of claim 1, wherein the coil loops are substantially quadrilateral.

3. The collapsible net of claim 1, wherein the propping device comprises a plurality of stakes for fixing the bottom fabric portion to the floor.

4. The collapsible net of claim 3, wherein the bottom fabric portion comprises a plurality of flanges with holes, wherein the hole is adapted to accept the stake.

5. The collapsible net of claim 4, wherein the flanges of the bottom fabric portion are provided at predetermined locations along the bottom parts of the coil loops.

6. The collapsible net of claim 5, wherein the predetermined locations for the flanges comprises a joint portion of the bottom part and the outer side part of the first side coil loop, a joint portion of the bottom part and the outer side part of the second side coil loop, a joint portion of the bottom parts of the center coil loop and the first side coil loop, and a joint portion of the bottom parts of the center coil loop and the second side coil loop.

7. The collapsible net of claim 3, wherein the propping device further comprises a plurality of strings for fixing the top parts of the coil loops to the floor, wherein each string comprises a first end and a second end.

8. The collapsible net of claim 7, wherein the first ends of the strings are connected to predetermined locations along the top parts of the coil loops.

9. The collapsible net of claim 8, wherein the predetermined locations comprises a joint portion of the top part and the outer side part of the first side coil loop, a joint portion of the top part and the outer side part of the second side coil loop, a joint portion of the top parts of the center coil loop and the first side coil loop, and a joint portion of the top parts of the center coil loop and the second side coil loop.

10. The collapsible net of claim 8, wherein the second ends of the strings are connected to the stakes, wherein the stakes are stretched and fixed to the floor to make the string tight enough to hold the collapsible net.

11. The collapsible net of claim 1, wherein the vertical fabric portion comprises a net portion and a sleeve portion, wherein the sleeve portion covers and clings to the coil loops and is connected to the net portion.

12. The collapsible net of claim 1, wherein the top fabric portion comprises a net, wherein the top fabric portion is confined by the top parts of the coil loops and the top strap.

13. The collapsible net of claim 1, wherein the bottom fabric portion comprises a net, wherein the bottom fabric portion is confined by the bottom parts of the coil loops and the bottom strap.

14. The collapsible net of claim 1, wherein the top and bottom straps are elastic, further comprises two elastic poles having an upper end and a lower end, wherein the length of each elastic pole is longer than the side part of the coil loops, wherein the elastic poles are elastic, wherein the elasticity of the elastic poles is lower than the elasticity of the top strap, wherein the top strap comprises a plurality of holes for securing the upper end of the elastic poles, wherein the lower parts of the elastic poles are fixed or secured by a fabric portion to the side parts of the first and second coil loop.

15. The collapsible net of claim 1, further comprises two elastic poles having an upper end and a lower end, wherein the elastic poles are connected into one piece and threaded along holes provided at the edge of the top fabric portion, for heightening the top fabric portion by bending the threaded elastic poles upward.

16. The collapsible net of claim 1, wherein the opening angle of the concave-truncated-cylinder-shape is controllable, wherein the opening angle is defined by the surfaces of the first and second side coil loops.

17. The collapsible net of claim 16, wherein the opening angles ranges from about zero (0) to about one hundred eighty (180) degrees.

18. The collapsible net of claim 1, wherein the coil loops are installed perpendicularly to the floor.

19. The collapsible net of claim 1, wherein the coil loops are substantially quadrilateral, wherein the vertical fabric portion comprises a net portion and a sleeve portion, wherein the sleeve portion covers and clings to the vertices of the quadrilateral coil loops, wherein the sleeve portion is substantially triangular.

20. The collapsible net of claim 1, further comprising a target, wherein the target is installed on the vertical fabric portion covering the center coil loop.

* * * * *